US008286291B2

(12) United States Patent
Lampka et al.

(10) Patent No.: US 8,286,291 B2
(45) Date of Patent: Oct. 16, 2012

(54) ERASER ASSEMBLY FOR A ROTARY TOOL

(75) Inventors: Mark Lampka, East Amherst, NY (US); Matthew A. Giles, Amherst, NY (US)

(73) Assignee: Dynabrade, Inc., Clarence, NY (US)

( * ) Notice: Subject to any disclaimer, the term of this patent is extended or adjusted under 35 U.S.C. 154(b) by 1281 days.

(21) Appl. No.: 11/906,360

(22) Filed: Oct. 2, 2007

(65) Prior Publication Data

US 2009/0083916 A1 Apr. 2, 2009

(51) Int. Cl.
*B24B 23/02* (2006.01)
*B43L 19/00* (2006.01)

(52) U.S. Cl. ..... 15/3.53; 15/230.16; 15/425; 451/359; 451/527; 451/548

(58) Field of Classification Search ..... 15/3.53, 15/230, 230.14, 230.16, 425; 451/359, 508, 451/527, 530, 548; D15/126
See application file for complete search history.

(56) References Cited

U.S. PATENT DOCUMENTS

| | | | | | |
|---|---|---|---|---|---|
| 863,172 | A | * | 8/1907 | Harrison | 451/548 |
| 870,321 | A | | 11/1907 | Stamper et al. | |
| 1,035,758 | A | * | 8/1912 | Undeen | 451/548 |
| 3,628,292 | A | | 12/1971 | Rue | |
| 4,322,920 | A | * | 4/1982 | Wells | 451/342 |
| 4,715,150 | A | | 12/1987 | Takeuchi et al. | |
| 5,076,024 | A | * | 12/1991 | Akagawa et al. | 451/550 |
| 5,197,249 | A | * | 3/1993 | Wiand | 451/529 |
| 5,259,914 | A | | 11/1993 | Fisher | |
| 5,332,098 | A | | 7/1994 | Fisher | |
| D369,447 | S | | 4/1996 | Mann et al. | |
| 5,544,991 | A | | 8/1996 | Richardson | |
| D378,003 | S | | 2/1997 | Eichinger et al. | |
| D390,435 | S | * | 2/1998 | Matsumoto | D8/70 |
| 5,856,396 | A | | 1/1999 | Vipperman | |
| 5,879,504 | A | | 3/1999 | Winter | |
| D429,393 | S | | 8/2000 | Rief et al. | |
| 6,136,143 | A | | 10/2000 | Winter et al. | |
| 6,309,292 | B1 | | 10/2001 | Montabaur et al. | |
| 6,312,325 | B1 | | 11/2001 | Van Osenbruggen | |
| 6,523,214 | B1 | * | 2/2003 | Kaiser | 15/230 |
| D477,207 | S | * | 7/2003 | Kim et al. | D8/70 |
| D498,486 | S | * | 11/2004 | Eisenblaetter | D15/126 |
| 6,814,657 | B2 | * | 11/2004 | Spangenberg et al. | 451/548 |
| 6,949,012 | B2 | | 9/2005 | Barnett, III | |
| D516,260 | S | | 2/2006 | Chen | |
| 7,066,795 | B2 | | 6/2006 | Balagani et al. | |
| 7,147,548 | B1 | * | 12/2006 | Mehrabi | 451/323 |
| 2001/0011004 | A1 | * | 8/2001 | Yamaguchi et al. | 451/548 |
| 2004/0203325 | A1 | | 10/2004 | Donohue | |
| 2007/0167119 | A1 | | 7/2007 | Momosaki | |

* cited by examiner

*Primary Examiner* — Randall Chin
(74) *Attorney, Agent, or Firm* — Simpson & Simpson, PLLC

(57) ABSTRACT

A two piece eraser assembly , including an eraser disk and an eraser hub for mounting and holding the eraser disk. The eraser hub includes upper and lower surfaces a flange at the peripheral edge of the hub and a stub shaft on the lower surface positioned axially with a throughbore. The eraser hub includes a plurality of spaced apertures for engaging with and detachably locking eraser disk extensions on the backside. The upper surface of the eraser disk includes a central recess and an aperture in the recess. The eraser disk includes a plurality of abrading teeth running radially from the central recess. The lower surface of the eraser disk further comprises a plurality of mounting elevations keyed for engaging with the spaced apertures or slots in the eraser hub for securely locking the eraser disk to the eraser hub.

3 Claims, 5 Drawing Sheets

ERASER ASSEMBLY FOR A ROTARY TOOL

FIELD OF THE INVENTION

The present invention relates to rotary abrading tools. More specifically, the present invention relates to rotary abrading tools of the erasure type.

BACKGROUND OF THE INVENTION

Rotary abrading tools of the erasure type are well known and typically comprise a rotary driven annular disk made of an elastomeric material, commonly referred to as an "eraser wheel" or an "eraser disk." Rotary abrading tools of the erasure type are used to remove adhesive material, such as paint and decals, from metal surfaces. An eraser disk is rotated at high speeds and pressed against adhesive material for removal. Eraser disks of this type tend to become deformed over time, and consequently, lose their efficiency. Therefore, eraser disks need to be replaced frequently, often during the course of completing a single project.

In U.S. Pat. No. 5,259,914, Fisher discloses a disk-shaped eraser unit with a flat disk embedded inside the eraser member. The disk has a central opening and two rim notches. When molding the rubber eraser member with the disk embedded, the rubber material will fill the two rim notches. A bolt having an elongated shaft extends through the central opening of the disk and is secured by a nut and washer. The elongated shaft extending from the eraser member is attached to a rotating drive means. As the eraser unit rotates against a workpiece, the outer periphery is worn down and renewed. Because of the minimal mechanical interlock between the embedded disk and eraser material, this system relies heavily on the sufficiently high adhesion between the embedded disk material and the sufficiently high strength of the eraser material to prevent the embedded disk from shearing loose and spinning freely within the eraser.

To overcome the problem of disk slippage that may result from the use of the invention disclosed in Fisher, the invention disclosed in U.S. Pat. No. 6,309,292, (Montabaur et al.) provides for a more extensive interlocking of parts between the eraser and the disk or hub that is connected to a tool. Montabaur et al. disclose a rotary tool for the erasure-type abrading of adhesive residues from metal surfaces, having an outer tooth crown of an elastomeric material mounted on a disk-shaped holder, which is rotatably driven and coupled to the latter by an inner crown. Attaching an eraser disk in this manner requires removing the crown prior to replacing the eraser.

However, as mentioned in Montabaur et al., eraser disks are not easily replaceable. The replacement of an eraser disk often involves detaching the hub or several pieces from the base tool. This complicated number of steps is not time efficient, especially when eraser disks need to be replaced frequently. In U.S. Pat. No. 6,136,143, Winter et al. recognize the need for frequent replacement of eraser disks. The invention in Winter et al. allows a user to replace the eraser disk without removing the hub, which the eraser disk is attached to, from its base tool. However, Winter et al. fail to disclose an eraser disk that is quickly replaceable. Rather, the eraser disk disclosed in Winter et al. is attached to the hub via complicated interlocking parts, and in the preferred embodiment, the eraser disk is molded to the hub. Attaching the disk in this manner takes added time and is an inconvenience for the user to replace the eraser disk.

Thus, there is a long-felt need for a rotary abrading tool assembly that is free from the drawbacks of earlier tools used for erasure-type abrading. In particular, there is a need for a device that provides for easier disk replacement without performing tedious and time consuming replacement procedures.

SUMMARY OF THE INVENTION

The invention therefore relates principally to an eraser assembly that allows for prompt removal of worn eraser disks from an eraser hub, and for quick and convenient reinstallation of replacement disks onto the hub without requiring the use or assistance of any hand held tools whatsoever in the process.

Accordingly, it is a principal object of the present invention to provide for an eraser assembly for a rotary tool comprising an eraser disk and an eraser hub for mounting and holding the eraser disk. The eraser hub includes upper and lower surfaces, wherein the eraser hub upper surface features a centrally positioned throughbore, a flange at the peripheral edge of the hub and a stub shaft on the lower surface positioned axially with the throughbore. The eraser hub includes a plurality of spaced apertures or slots for engaging with and detachably locking the eraser disk so it is flush with the eraser hub. The eraser disk is preferably comprised of a polymeric composition, such as an elastomeric material or other durable, resilient material, and comprises an upper surface and lower surface opposite the upper surface. The upper surface of the eraser disk includes a central recess and a aperture in the recess keyed for axial alignment with the throughbore of the eraser hub. The eraser disk is also equipped with a plurality of teeth running radially from the central recess to the peripheral edge thereof. The lower surface opposite the upper surface of the eraser disk further comprises a plurality of mounting elevations or protrusions keyed for engaging with the spaced apertures or slots in the eraser hub for securely locking the eraser disk to the eraser hub, avoiding slippage of the eraser disk during operation.

It is therefore one principal object of the invention to provide for an eraser assembly for a rotary tool. The assembly includes a resilient eraser disk and a substantially rigid eraser hub for mounting and holding the eraser disk. The eraser disk includes an upper surface and a lower surface opposite the upper surface. Similarly, the eraser hub has an upper surface and a lower surface opposite the upper surface. The upper surface of the eraser disk comprises means for abrading a workpiece, whereas the lower surface of the eraser disk comprises a plurality of spaced elevations or protrusions with means keyed for detachably engaging with a plurality of spaced openings or slots in the eraser hub below. The lower surface of the eraser disk and the upper surface of the eraser hub are preferably flush with one another when in locking engagement. The eraser assembly includes a central opening for engaging with a circular shaft, for example, from a rotary tool, or alternatively, has engaged therewith a shaft suitable for connecting to a rotary tool.

More specifically, the foregoing eraser assembly comprises a plurality of spaced elevations on the lower surface of the eraser disk, wherein the spaced elevations in addition can have an enlarged ring or locking cap. The elevations may be of sufficient length, so when the eraser hub and eraser disk are fully engaged the enlarged ring or locking cap on the terminal ends of the spaced elevations/protrusions exit the spaced openings or slots on the lower surface of the eraser hub and expand due to their preferred resilient properties, releasably locking the eraser disk to the eraser hub. As a further preferred structural feature of the invention, the enlarged ring or locking cap on the plurality of spaced elevations is generally frustoconically shaped.

Alternatively, the plurality of spaced elevations on the lower surface of the eraser disk may engage with a shoulder, ridge or counterbore extending interiorly, preferably 360° from the sidewalls of openings or slots in the eraser hub for releasably securing the eraser disk to the eraser hub.

According to the present invention, the upper surface of the eraser hub includes a centrally positioned throughbore, a flange at the peripheral edge of the eraser hub and a stub shaft on the lower surface in axial alignment with the centrally positioned throughbore.

In addition to the foregoing structural features, the upper surface of the eraser disk comprises a central recess and an opening centrally positioned in the recess, wherein the opening is axially aligned with the throughbore and the stub shaft of the eraser hub. As a preferred embodiment, the means for abrading a workpiece comprises a plurality of teeth extending generally radially from the central recess to the peripheral edge of the eraser disk.

It is yet a further object of the invention to provide means for connecting the eraser assembly to a rotary tool, such as a right angle drill having a threaded drive shaft. In this regard the eraser assembly may include, for example, a stub shaft with a threaded central opening, a rectangular shaped opening with locking means, or other compatible mating surface for attaching and securing the eraser assembly to a rotary power tool. The eraser assembly invention also contemplates a stub shaft adapted for receiving a drive shaft for connecting the eraser assembly to the chuck of a power tool, such as an electric drill.

It is yet a further object of the invention to provide novel replacement parts for the eraser assembly. In particular, the invention contemplates eraser disk replacements for the aftermarket. The eraser disks comprise an upper surface and a lower surface opposite the upper surface, wherein the upper surface of the eraser disk includes a central recess and a aperture in the recess keyed for axial alignment with a central opening in an eraser hub. The upper surface of the eraser disk comprises means for abrading a workpiece, whereas the lower surface of the eraser disk comprises a plurality of spaced mounting elevations or protrusions keyed for engaging and locking in spaced apertures or slots of an eraser hub for detachably affixing the eraser disk to the eraser hub.

It is still a further object of the invention to provide for an eraser disk fabricated from a resilient or rubbery material, which includes means for abrading a workpiece, such as a plurality of teeth radially displaced from the central recess to the peripheral edge of the eraser disk. The eraser disk preferably includes a plurality of spaced mounting elevations or protrusions, and more particularly, mounting elevations or protrusions with enlarged rings or caps for engaging with the peripheral edge or shoulder of the sidewall of apertures or slots from the sidewall of an eraser hub for detachably affixing the eraser disk to the eraser hub. The enlarged caps and rings of the mounting elevations or protrusions are preferably generally frustoconically shaped for positive engagement with a ridge, shoulder, counterbore, or the like in apertures of the eraser hub. The invention also contemplates an embodiment wherein the locking caps or rings at the terminal ends of the elevations may extend past the edge of spaced apertures or slots of the eraser hub when said eraser disk and hub are engaged together flush, wherein the locking caps or rings expand upon exiting the opening or slot detachably affixing the eraser disk to the eraser hub.

It is yet a further object of the invention to provide for a replacement eraser hub for the aftermarket for mounting an eraser disk. Preferably, the eraser hub is fabricated from rigid materials, such as thermoplastics or thermosetting resins, or metals, such as aluminum, steel and alloys. This aspect of the invention contemplates an eraser hub comprising an upper surface for mounting an eraser disk thereto and a lower surface opposite the upper surface. The upper surface of the eraser hub preferably includes a central throughbore and a flange at the peripheral edge of the eraser hub. The lower surface of the eraser hub can be equipped with a threaded stub shaft for engaging with a circular shaft of a rotary tool, such as a right angle drill. The stub shaft is not limited to threaded circular shafts, but may also be rectangular or square shaped. Alternatively, the stub shaft may have an extension suitable for engaging with the chuck of a drill or other rotary power tool. The stub shaft is in axial alignment with the throughbore.

The eraser hub for the aftermarket also includes an array of spaced openings or slots for affixing an eraser disk thereto. In one preferred embodiment the spaced openings or slots comprise a sidewall with a shoulder, ridge or counterbore extending inwardly for detachably engaging with mounting elevations or protrusions of an eraser disk.

These and other objects, features and advantages of the present invention will become readily apparent to one having ordinary skill in the art upon study of the following detailed description in view of the drawings and appended claims.

BRIEF DESCRIPTION OF THE DRAWINGS

The nature and mode of the operation of the present invention will now be more fully described in the following detailed description of the invention taken with the accompanying drawing figures, in which.

DESCRIPTION OF THE PREFERRED EMBODIMENTS

At the outset, it should be appreciated that like drawing numbers on different drawing views identify identical structural elements of the invention. While the present invention is described with respect to what is presently considered to be the preferred embodiments, it is understood that the invention is not limited to the disclosed embodiments.

Furthermore, it is to be understood that this invention is not limited to the particular methodology, materials and modifications described and as such may, of course, vary. It is also to be understood that the terminology used herein is for the purpose of describing particular embodiments only, and it is not intended to limit the scope of the present invention, which will be limited only by the appended claims.

Unless defined otherwise, all technical and scientific terms used herein have the same meaning as commonly understood to one of ordinary skill in the art to which this invention belongs. Although any methods, devices and materials similar or equivalent to those described herein can be used in the practice or testing of the invention, the preferred methods, devices and materials are now described.

Figure 1:
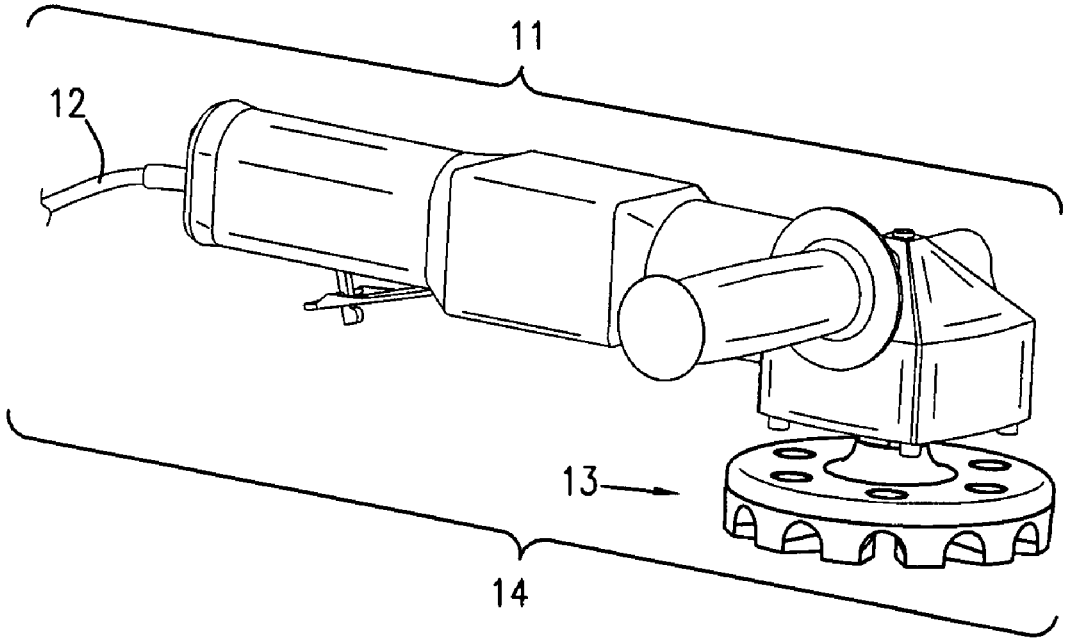
FIG. 1 is a perspective view of the eraser assembly attached to a rotary tool.
Figure 2:
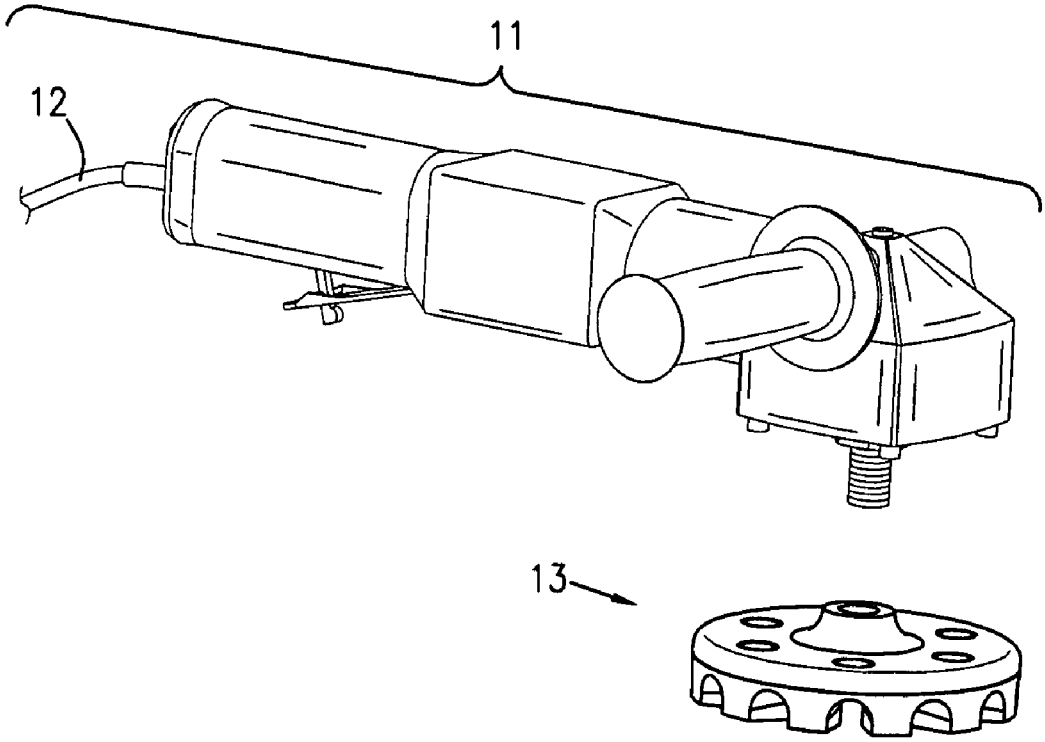
FIG. 2 is a perspective view of the eraser assembly detached from a rotary tool.

Reference is first made to FIG. 1, wherein a rotary tool is designated as 11 and shown as generally including a cord 12 for electric power. The rotary tool 11 is connected to the eraser assembly 13 in the fully assembled position. The fully assembled eraser assembly 13 with the rotary tool 11 is assigned as 14. An unassembled depiction of the rotary tool 11 and the detached eraser assembly 13 is shown in FIG. 2.

Figure 3:
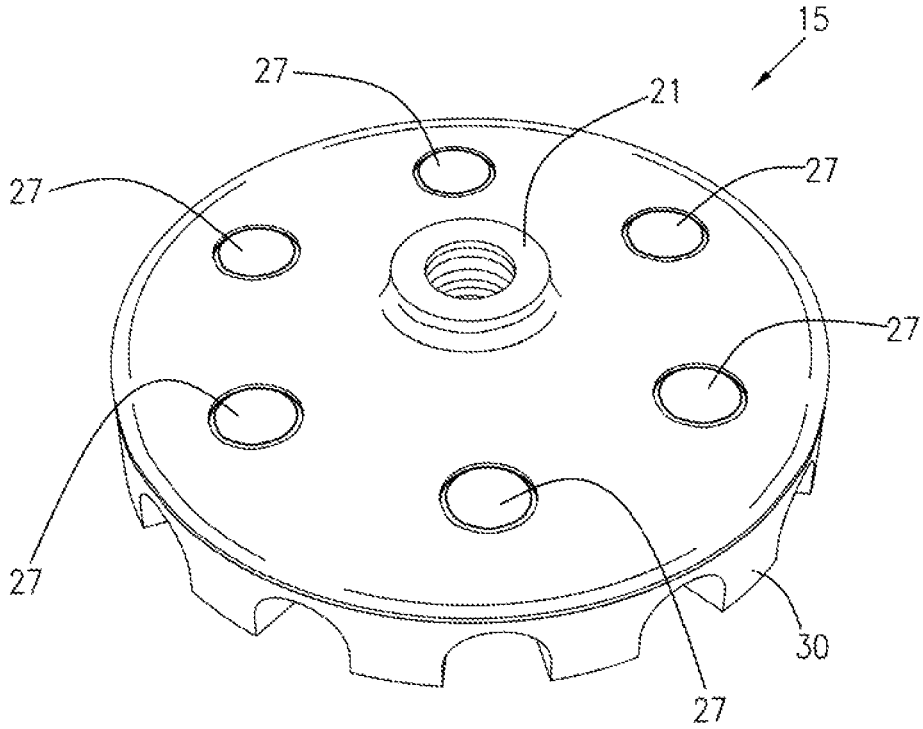
FIG. 3 is a top perspective view of the eraser assembly.
Figure 4:
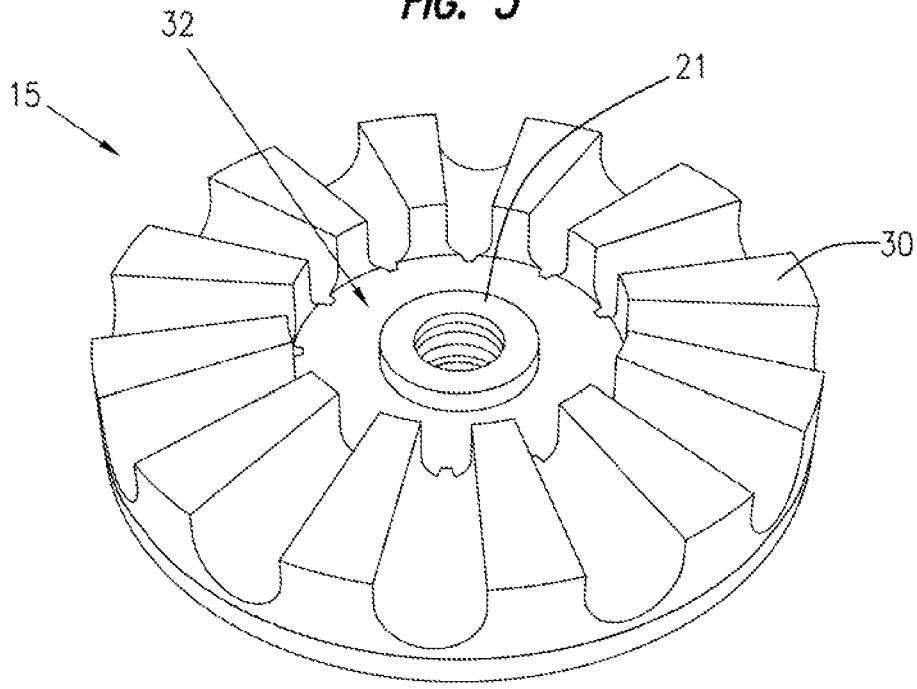
FIG. 4 is a bottom perspective view of the eraser assembly.

A top view of the eraser assembly 13 is shown in FIG. 3. This preferred embodiment includes a plurality of spaced, radially arranged terminally positioned protrusion caps 27 embedded through apertures or slots 19 (FIG. 5) to the topside of the eraser assembly 13. In addition, the top side of the eraser assembly 13 includes a threaded stub shaft 18, which connects the eraser assembly 13 to the shaft of rotary tool 11. The underside of the eraser assembly 13 also includes a plurality of abrading teeth 30 and threaded throughbore 21, as shown in FIG. 4.

Figure 5:
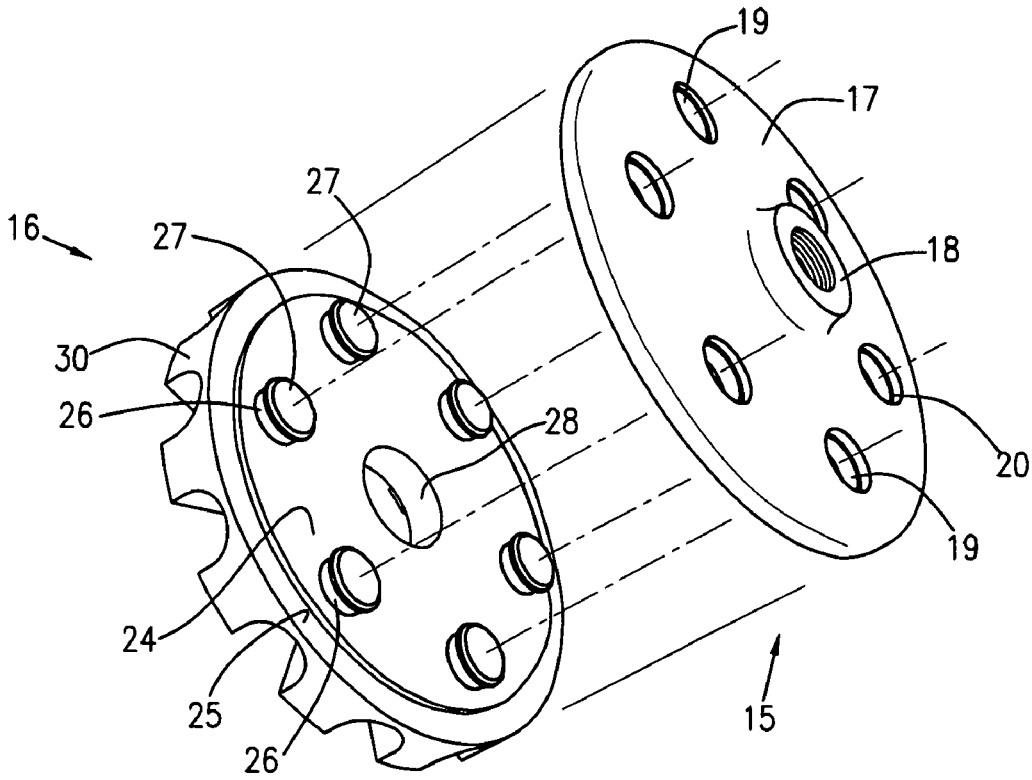
FIG. 5 is an top perspective view of the eraser disk and the eraser hub separated.
Figure 6:
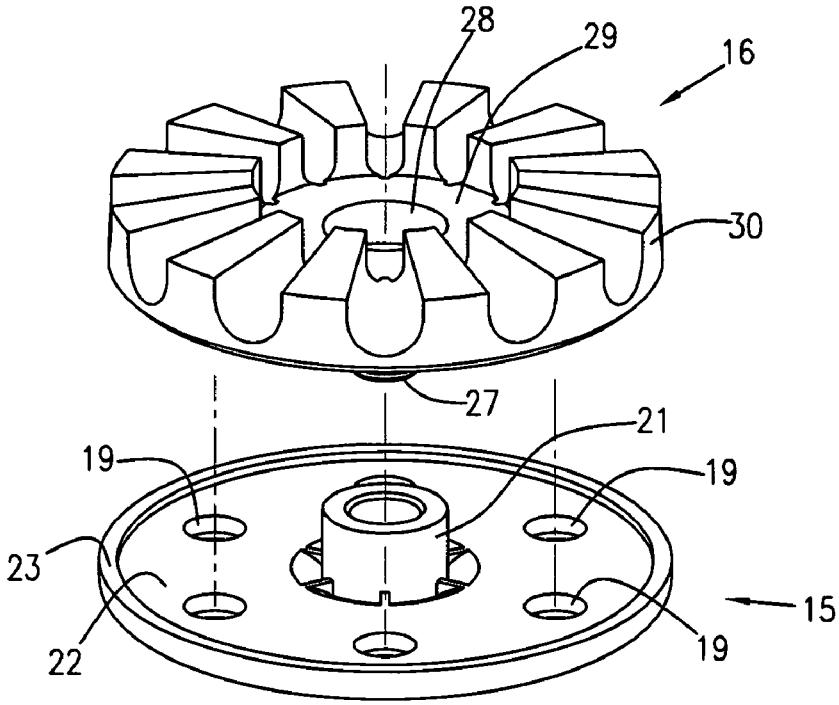
FIG. 6 is a bottom perspective view of the eraser disk and the eraser hub separated.
Figure 7:
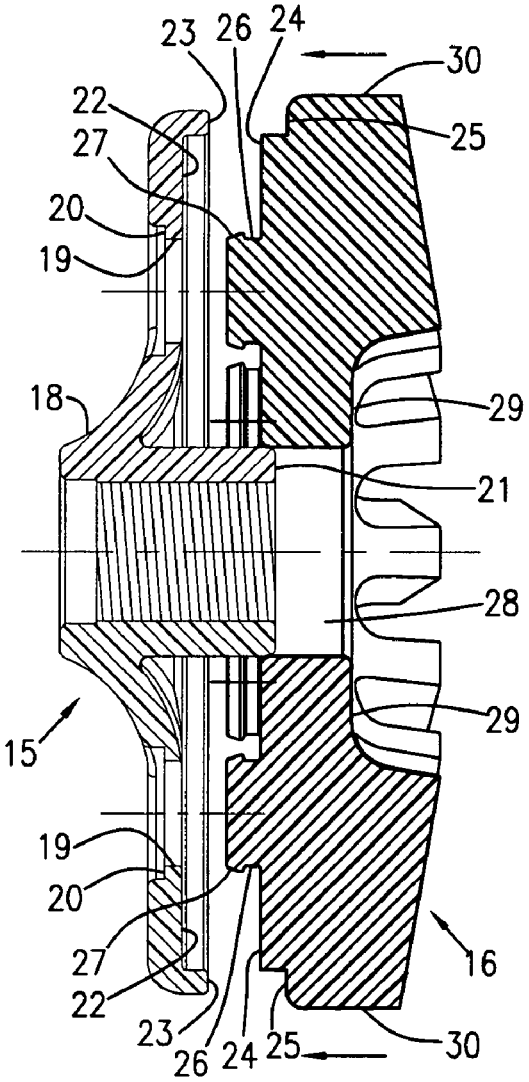
FIG. 7 is a side sectional view of the eraser disk partially inserted into the eraser hub.
Figure 8:
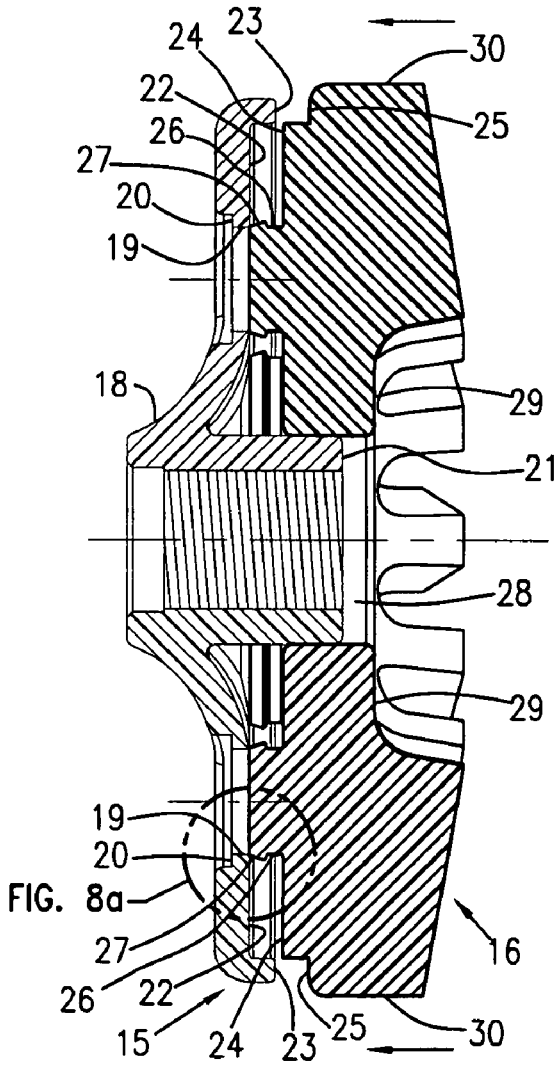
FIG. 8 is a side-sectional view of the eraser hub seated on the eraser disk.
Figure 8A:
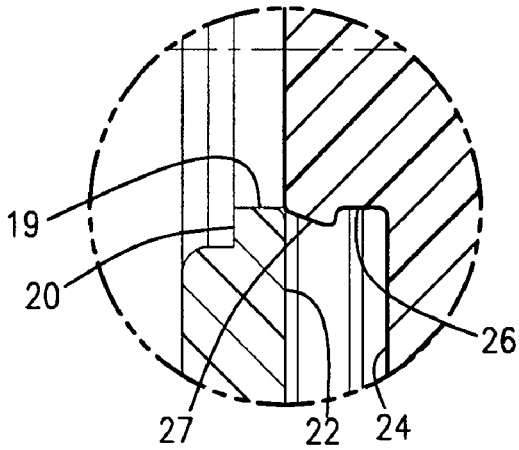
FIG. 8*a* is an enlarged sectional view about the circle in FIG. 8 showing the mounting protrusion cap engaged with the edge of the counterbore of the sidewall of the slot of the eraser hub.

The eraser assembly 13 in disassembled format shown in FIG. 5, has eraser hub 15 and eraser disk 16 separated one from the other. Both eraser hub 15 and eraser disk 16 are circular in shape and are about the same diameter. In this disassembled view, the mounting protrusions 26 on the eraser disk lower surface 24 are cylindrically shaped and outwardly projecting in a radial fashion. Mounting protrusions or elevations 26 are keyed for engagement with apertures 19 of the eraser hub 15. Mounting protrusion caps 27 are located on the terminal or first end of each mounting protrusion 26. Each mounting protrusion cap 27 is preferably frustoconically shaped as best illustrated by FIGS. 7 and 8*a*, and has a larger diameter than the diameter of the shaft of mounting protrusions 26 (FIG. 5). Recess 25 is also visible on the peripheral edge of eraser disk lower surface 24. Recess 25 engages with the inside edge of flange 23 of the eraser hub upper surface 22 in a complementary fashion, as best shown in FIG. 6. Each aperture 19 on the eraser hub 15 is also visible in FIG. 5, with each aperture 19 having a shoulder 20 on its first end.

The eraser disk upper surface 29 includes a plurality of abrading teeth 30 and a central aperture 28. The projecting elastomeric abrading teeth 30 are in an annular array extending radially outwardly, and are tapered in a generally trapezoidal shape. Teeth 30 may have arcuate outer ends which lie along a circular path forming the outer periphery of eraser disk 16. Teeth 30 extend uniformly from the centrally positioned recessed area 32 to the outer or peripheral edge or flange 23 of eraser hub 15 until the teeth meet the flange of the hub. The eraser disk recessed lower surface 24 is circular and surrounds central opening 28, which is shown in cylindrical configuration. It will be understood, the throughbore and axially positioned stub shaft may have other appropriate configurations, such as rectangular, which serves as a convenient shape for engaging a chuck of a power tool, such as a drill. As demonstrated by the broken lines in FIG. 6, the central opening 28 receives the throughbore 21 of the eraser hub 15, creating a frictional fit between the two surfaces. The throughbore may be threaded as shown. Both the central opening 28 and the threaded throughbore 21 may have circular cross-sections of equal diameter.

Eraser hub 15 and the eraser disk 16 are detachably connected to one another when each mounting protrusion 26 with mounting protrusion cap 27 is compressed by application of hand pressure in the region of apertures 19 of the eraser hub for engaging with shoulders 20. This connection is best depicted in FIGS. 7-9*a*. FIG. 7 is a side elevational-sectional view of the eraser disk 16 partially inserted into the eraser hub 15, where the threaded throughbore 21 extends from the eraser hub upper surface 22 and is partially inserted into the central opening 28 along the eraser disk lower surface 24. FIG. 8 depicts eraser disk 16 inserted further into eraser hub 15, where aperture 19 on eraser hub 15 is engaging flange 7 of mounting protrusion cap 27 of eraser disk 16, locking the protrusion cap to the ridge or shoulder 19 of eraser hub 15. The first end of the mounting protrusion cap 27 is in contact with the second end of the aperture 19, as shown in FIG. 8*a*.

Figure 9:
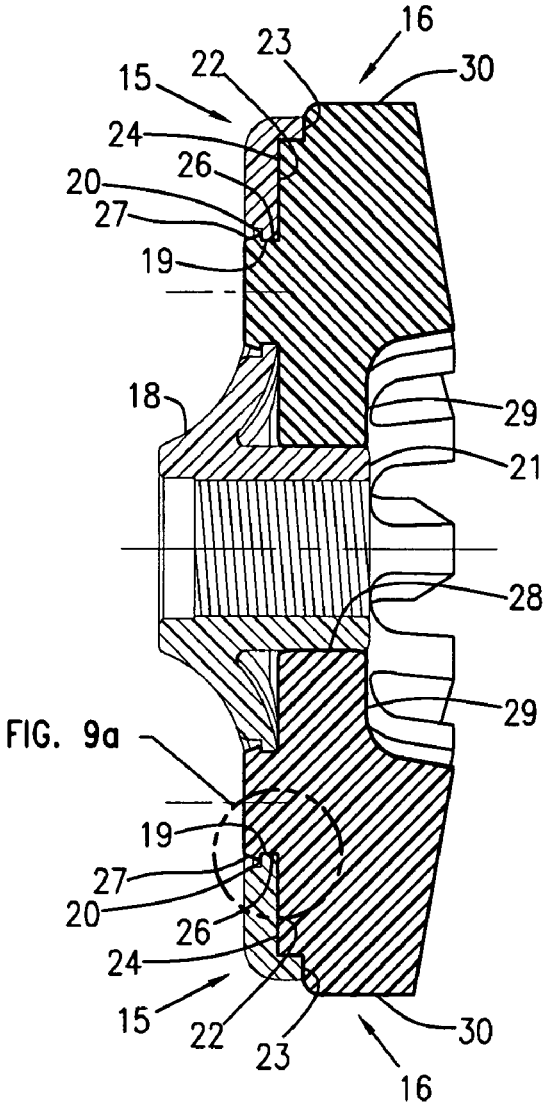
FIG. 9 is a side-sectional view of the eraser disk fully inserted into the eraser hub.
Figure 9A:
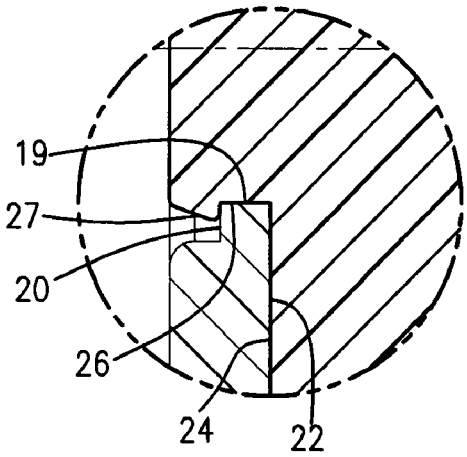
FIG. 9*a* is an enlarged sectional view about the circle in FIG. 9 showing a mounting protrusion or elevation and a cap of the elevation fully inserted in a slot/aperture and a shoulder of the eraser hub, where the mounting protrusion is embedded through to the eraser hub lower surface where the top edge of the cap is flush with the lower surface of the hub.

The eraser disk 16 is fully inserted into the eraser hub 15 in FIGS. 9 and 9*a*. FIG. 9 depicts mounting protrusions 26 fully inserted into apertures 19, and throughbore 21 fully inserted into the central opening 28 of the eraser disk and protruding slightly from the eraser disk upper surface 29. When fully inserted, recess 25 and flange 23 at the peripheral edge of the eraser hub are in full contact allowing for no distance between them. FIG. 9*a* is an enlarged section of the complimentary fit of the mounting protrusion 26 and corresponding mounting protrusion cap 27 in the aperture 19 and corresponding shoulder 20, where each mounting protrusion 26 and corresponding mounting protrusion caps 27 are visible on the eraser hub lower surface 17, so they are substantially flush with the lower surface of the eraser hub. These manipulative steps complete the installation of eraser disk 16 to eraser hub 15 solely by means of manual dexterity without requiring hand tools or other equipment in replacing an eraser disk of eraser assembly 13.

While the invention has been demonstrated with embodiments of the eraser assembly wherein the eraser disk comprises elevations or mounting protrusions with enlarged caps on the lower surface of the eraser disk, and an eraser hub comprising spaced apertures keyed for receiving and detachably locking the eraser disk to the hub, the invention contemplates still further alternative embodiments. For example, the eraser hub may comprise substantially rigid elevations with mounting protrusion caps extending axially from the upper surface of the hub for engaging with spaced apertures or slots in the lower surface of the eraser disk. The apertures or slots in the lower surface of the eraser disk may, for example, also have inwardly projecting shoulders or ridges for receiving and engaging with the elevations or mounting protrusions for docking and flush mounting the eraser disk with the eraser hub.

Figure 10:
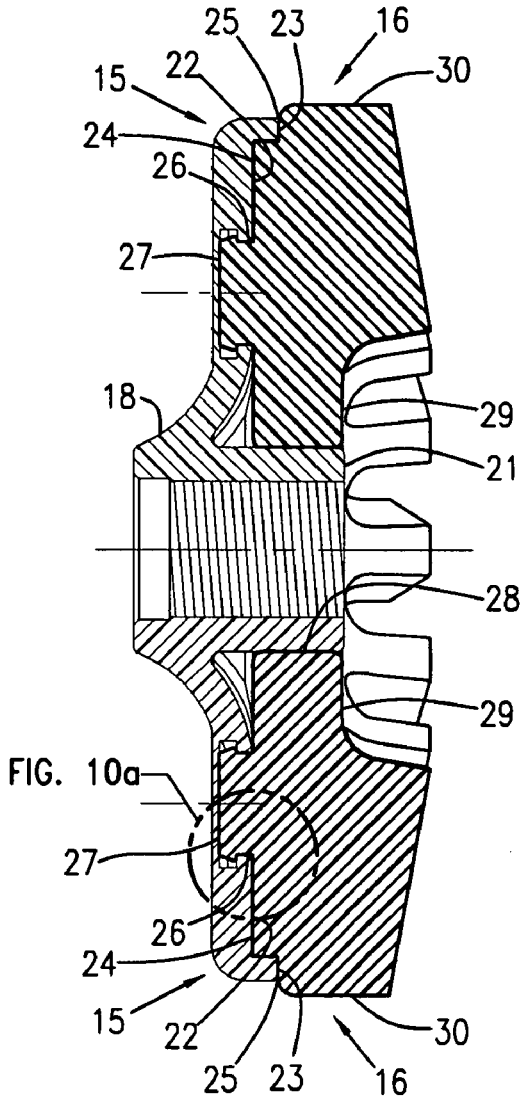
FIG. 10 is a side-sectional view of an alternate embodiment of the eraser disk fully inserted into the eraser hub.
Figure 10A:
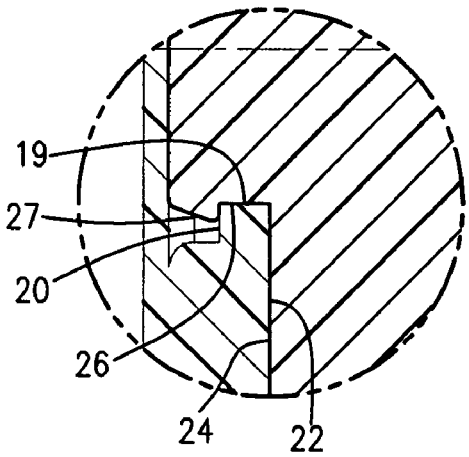
FIG. 10*a* is an enlarged sectional view about the circle in FIG. 10 showing a mounting protrusion/elevation and cap of the eraser disk fully inserted in a aperture/slot of the eraser hub and a shoulder of the eraser hub opening/slot where the mounting protrusion is embedded.

In yet a further embodiment of the invention, according to FIGS. 10 and 10*a*, when fully inserted, the mounting protrusions 26 and corresponding mounting protrusion caps 27 of the eraser disk 16 do not extend through the eraser hub lower surface 17. Rather, the apertures 19 and corresponding shoulders 20 of the eraser hub 15 remain beneath the eraser hub lower surface 17 and are embedded in the eraser hub 15. Although this attachment is completed by a slightly different method, the connection of the eraser disk 16 to the eraser hub 15 is equal in function to the first preferred embodiment.

All of the embodiments provide for the connection of the eraser hub 15 to the eraser disk 16 that suitably forms an eraser assembly 13 for a rotary tool that will allow a user to quickly and easily replace the eraser disk of the assembly without the need for hand tools, but instead can be performed with manual dexterity.

Thus it is seen that the objects of the invention are efficiently obtained, although changes and modifications to the invention should be readily apparent to those having ordinary skill in the art, which changes would not depart from the spirit and scope of the invention as claimed.

We claim:

1. An eraser disk for a rotary tool, comprising:

an axis of rotation; and, an upper surface and a lower surface opposite said upper surface, wherein:

said upper surface includes:

a central recess;

a plurality of protrusions for abrading a workpiece; and an aperture in said recess keyed for axial alignment with a central opening of an eraser hub;

said lower surface comprises a plurality of mounting elevations or protrusions extending from a recessed portion of the lower surface and keyed for engaging and locking in spaced apertures or slots in the eraser hub for detachably affixing said eraser disk to said eraser hub;

the upper surface is formed of a single piece of material;

respective distal ends of the mounting elevations or protrusions form respective portions of the lower surface furthest from the upper surface in a direction parallel to the axis of rotation;

the plurality of protrusions for abrading the workpiece forms a single unit formed from the single piece of material;

the plurality of protrusions for abrading the workpiece is displaced and aligned from the central recess to a peripheral edge of said eraser disk in a direction orthogonal to the axis of rotation;

each mounting elevation or protrusion in the plurality of spaced mounting elevations or protrusions includes a respective ring or cap at the respective distal end for engaging with apertures or slots of the eraser hub for detachably affixing said eraser disk to said eraser hub; and, a greatest width of the respective ring or cap in the direction is greater than a greatest width of said each mounting elevation or protrusion in the direction.

2. The eraser disk according to claim 1, wherein said cap or ring of said mounting elevations or protrusions is generally frustoconically shaped.

3. The eraser disk according to claim 1, wherein said cap or ring is adapted for extending past the height of the eraser hub when said eraser disk and eraser hub are engaged together flush, wherein said cap or ring expands detachably affixing said eraser disk to said eraser hub.

* * * * *